US005676168A

United States Patent [19]

Price

[11] Patent Number: 5,676,168

[45] Date of Patent: Oct. 14, 1997

[54] FAST-ERECTING TENT

[76] Inventor: Walter Price, 150 N. Sunway Dr., Suite #2, Gilbert, Ariz. 85233

[21] Appl. No.: 546,591

[22] Filed: Oct. 23, 1995

[51] Int. Cl.[6] ..... E04H 15/40

[52] U.S. Cl. ..... 135/126; 135/905; 135/125; 403/391

[58] Field of Search ..... 135/125, 126, 135/156, 905, 128; 403/391, 389, 396, 384, 375; 285/137.1; 138/96 R, 106, 108, 109, 112, 155

[56] References Cited

U.S. PATENT DOCUMENTS

| | | | |
|---|---|---|---|
| 2,884,478 | 4/1959 | Becker et al. | 403/396 X |
| 3,387,080 | 6/1968 | Dibble et al. | 403/396 X |
| 4,858,634 | 8/1989 | McLeese | 135/126 |
| 4,899,965 | 2/1990 | Usui | 138/106 X |
| 4,926,892 | 5/1990 | Osmonson et al. | 135/909 X |
| 5,163,461 | 11/1992 | Ivanovich et al. | 135/126 |
| 5,385,165 | 1/1995 | Hazinski et al. | 135/126 |
| 5,396,917 | 3/1995 | Hazinski et al. | 135/125 |

FOREIGN PATENT DOCUMENTS

| | | | |
|---|---|---|---|
| 0401398 | 12/1990 | European Pat. Off. | 135/125 |
| 702098 | 1/1941 | Germany | 135/112 |
| 1928653 | 12/1970 | Germany | 135/124 |

*Primary Examiner*—Lanna Mai

*Attorney, Agent, or Firm*—Lewis, D'Amato, Brisbois & Bisgaard

[57] ABSTRACT

The present invention is a fast-erecting tent in which several open-ended arcuate interconnect via a single connector. The frame of the tent includes 1) a pair of resilient, planar open-end arcuate sections that form a filiform base loop; 2) a pair of resilent open-end arcuate sections that form a filiform upper loop; 3) a connector which links a terminal end of the first arcuate section of the base loop plus a terminal end of the first arcuate section of the upper loop to the terminal end of the second arcuate section of the base loop plus the terminal end of the second arcuate section of the upper loop; and 4) a segmented, internally biased, arch shaped tubular strut. The ends of the strut are slidably and rotatably connected to the arcuate sections of the base loop. The strut is connected to the arcuate sections of the upper loop by means of a twist clip. The fabric covering is wrapped around and attached to the frame by conventional means. The connector is a sleeve with a through-bore. Through-bar having a cross-section of multiple, parallel, partial, interconnected, right circular cylinders and is designed so that the terminal ends of the arcuate sections forming the filiforms loops can be retained in the through-bore mainly by friction. The terminal ends of the arcuate sections that form the filiform loops are permanently fixed within the through-bore at a first end of the connector but are free to slide, rotate, and swivel in and be detached from a second end of the through-bore. Both the base loop and upper loop can be either elliptical or semi-elliptical.

15 Claims, 4 Drawing Sheets

FIG. 5
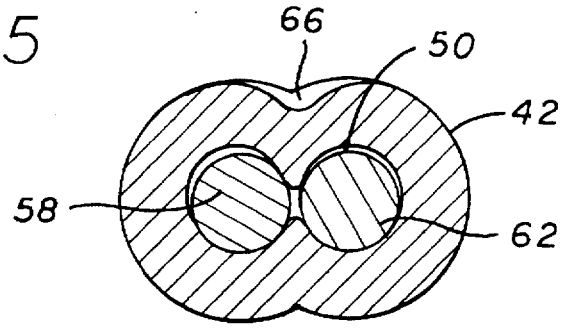
FIG. 6
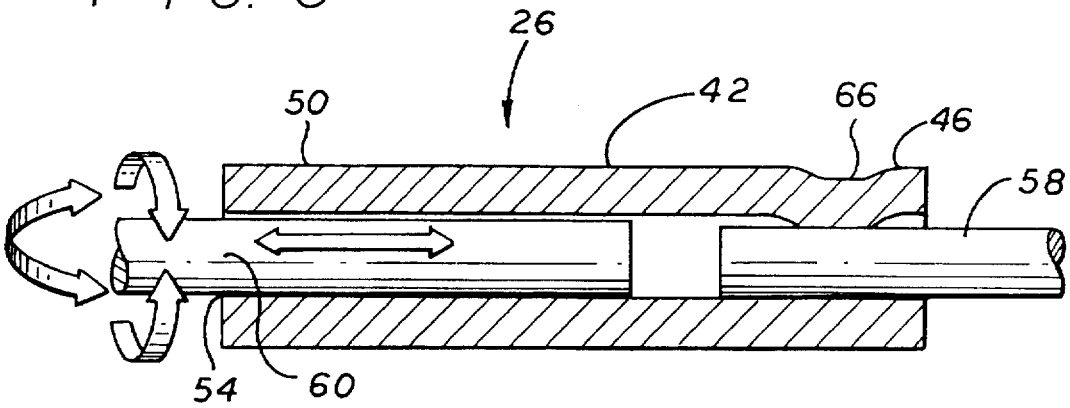
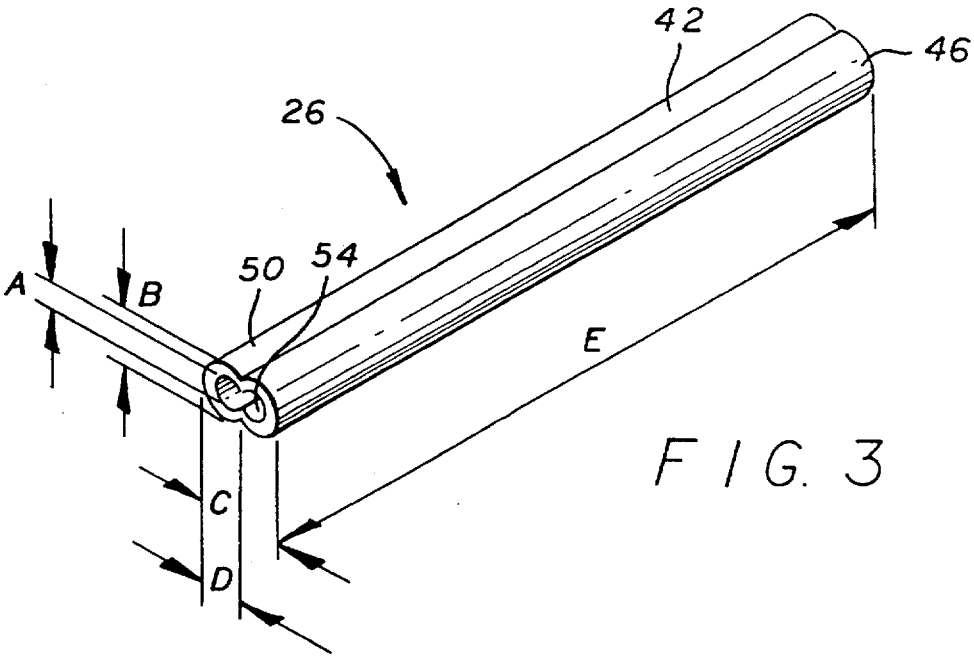
FIG. 3

FAST-ERECTING TENT

BACKGROUND OF THE INVENTION

The present invention relates to the field of tent structures and more particularly to fast erecting tent structures and a mechanical connect for use therewith in securing the wires or monofilaments which provide the frames for the fast erecting tent structures.

Self-erecting structures have been known for some years. The salient features of self-erecting tents are loops of springy material which normally form a three-dimensional frame but which can be coiled into an essentially flat disk The tent fabric is draped over and attached to these loops. Guy wires and tent pegs are not usually required for erecting such tents.

The term "self-erecting" is somewhat of a misnomer since, at least in the larger sizes, the tents need some manual assistance to go from the stored to the fully erected position, such tents should more properly be called "fast-erecting" since, at least, the time required for assembly and insertion of poles and placement of guy wires and tent pegs is eliminated.

Among the earliest inventors of fast-erecting tents was Norman, In his U.S. Pat. Nos. 3,960,161 and 3,990,463, issued in 1976, he described tents supported by a single continuous loop preferably made of spring steel. In one version the loop was saddle shaped while in the other the loop essentially formed a figure eight. While not specifically mentioned in the Norman patents, the loops must have been formed by permanently joining together, probably by welding, the ends of a single strip.

In 1989, McLeese patented a fast-erecting tent in which the frame was formed from at least two ellipses of a springy material, one of which was planar and the others of which were saddle shaped, clipped together. U.S. Pat. No. 4,858,634 again does not mention how the ellipses are fabricated but does say that they can be made of spring steel, fiber composite or highly flexable plastic. Such materials can be fabricated into loops by permanently joining the ends of strips, such as by welding or adhesive bonding. Also, composites and plastics can be molded into continuous circles and ellipses if desired, thus avoiding the necessity for joining ends.

U.S. Pat. No. 5,163,461 was issued to Ivanovich et al. in 1992. Ivanovich et al. teach that coiling of prior an tents was made difficult by the torsional resistance of the continuous loops Ivanovich et al. therefore designed a tent similar to the prior art but with: 1) a frame coiled into several, separated ellipses but formed from a single, continuous loop and 2) several rotatable connectors inserted at strategic points within this loop. The rotatable connectors arc short sleeves firmly swaged to one end of the loop at one extremity and with the other end of the loop inserted into the other extremity. The arcuate bias of the loop retains the loop end within the connector while allowing for rotation of the top end within the sleeve.

Hazinski et al. teach that the connector designed by Ivanovich et al. had several deficiencies. Hazinski et at. therefore patented a different type of connector (U.S. Pat. No. 5,407,291) in 1995. This connector has opposing tapered pockets. When the ends of the loop are fully inserted into these tapered pockets, the pockets grip the cads of the loop while allowing both ends to rotate.

There are many problems with prior designs of fast-erecting structures. In designs without connectors, torsional forces must be overcome when coiling the frame. In all prior art designs, the floor does not lay flat after erection. Frames are more costly to manufacture when the frames are single continuous loops with multiple ellipses. In designs with a single loop, the frame cannot include loops of different materials and diameters. Current connectors are only designed to connect with a single loop. If several, separate loops are used, clips or clamps are needed to connect them. Finally, current designs do not allow for expansion and contraction of frame and fabric.

Development of a fast-erecting tent which addresses these problems represents a great improvement in the field of tent design and satisfies several needs of the tent camper.

SUMMARY OF THE INVENTION

The present invention is a fast-erecting tent in which multiple open-ended arcuate sections connect via the same connector and the connector is designed so that the ends of the open-ended arcuate section are free to slide, swivel and rotate within the connector. This means that: 1) there are reduced torsional forces to overcome when coiling the frame; 2) the floor lays flat against the ground after erection; 3) frames are less costly to manufacture 4) the tent fabric can be removed from the frame for cleaning; 5) the frame can include open-ended arcuate sections of different materials and diameters; and 6) expansion and contraction of frame and fabric are compensated.

The frame of the tent comprises: 1) a resilient, planar, filiform base, comprised of a pair of open-ended arcuate sections in the shape of a , which defines the floor of the tent; 2) a resilient, arcuately bent, filiform upper member comprised of a pair of open-ended arcuate sections in the shape of a loop; 3) a connector which links a terminal end of the first arcuate section the base loop plus a terminal end of the first arcuate section of the upper loop to the terminal of the second arcuate section of the base loop plus the terminal end of the second arcuate section of the upper loop; and 4) a segmented, internally biased, arch shaped tubular strut. The ends of the strut are slidably and rotatably connected to the arcuate sections of the base loop by means of an eye hook. The strut is connected to the arcuate sections of the upper loop by means of a twist clip. The tent fabric covering is wrapped around and attached to the frame by conventional means and can include a door and windows.

The connector is an elongated body with a through-bore. The bore has the shape of multiple, parallel, partial, interconnected, right circular cylinders and is designed to retain the filiform terminal ends of the arcuate sections within the bore. The terminal ends of the arcuate sections are fixed within the bore at one end of the connector but are free to slide, rotate, and swivel to the point of detachment from the bore at the other end of the connector. Upon erection of the frame, the base loop and upper loop can be substantially elliptical in shape or any other shape known in the art.

An appreciation of the other aims and objectives of the present invention and an understanding of it may be achieved by referring to the accompanying drawings and description of a preferred embodiment.

BRIEF DESCRIPTION OF THE DRAWINGS

FIG. 3 is a perspective view of the preferred embodiment of the unswaged connector.

FIG. 5 is a transverse cross section of the preferred connector, taken at line 5—5 FIG. 4.

FIG. 6 is an axial cross section of the connector, taken at line 6—6 on FIG. 4.

DETAILED DESCRIPTION OF THE PREFERRED EMBODIMENT

Figure 1:
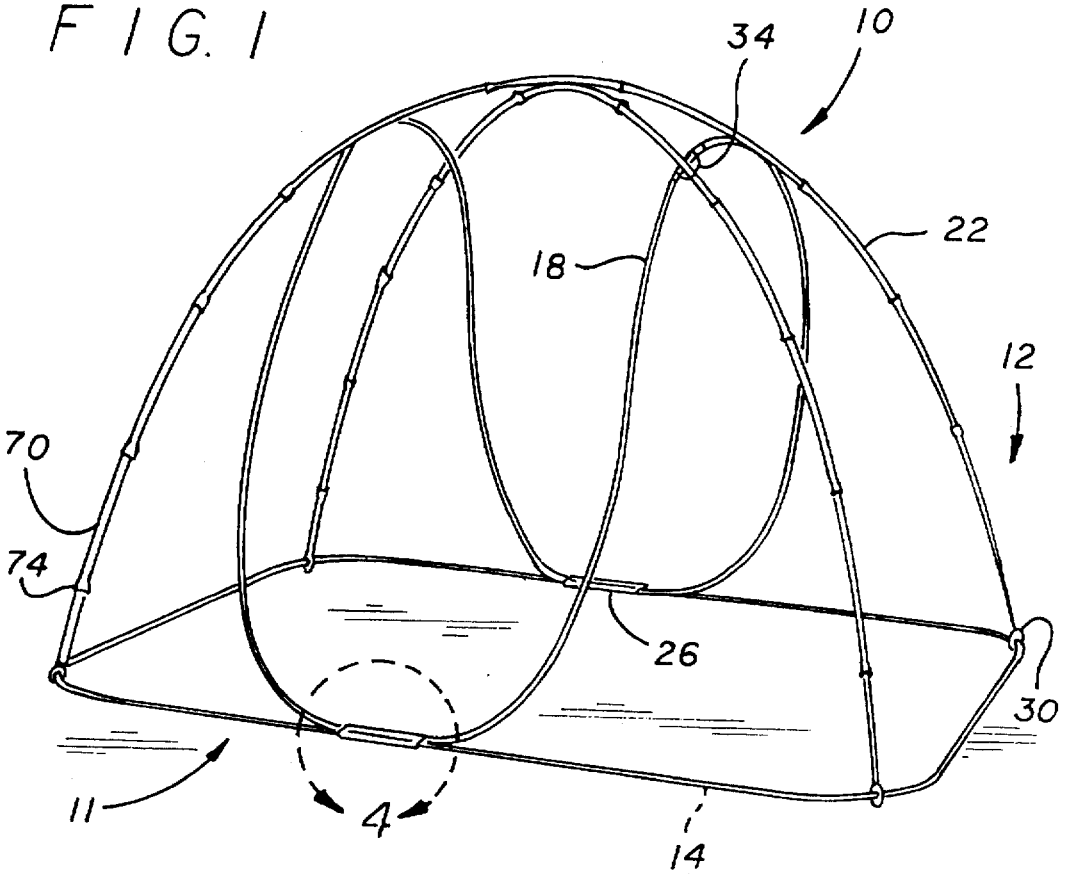
FIG. 1 shows a perspective view of the preferred embodiment of the erected tent frame.

FIG. 1 shows the frame 10 of the tent 86 in its fully erected state. In the preferred embodiment, the frame 10 comprises first and second open-ended arcuate sections 13 and 15, respectively to form a base loop 14, first and second open-ended arcuate sections 17 and 19 to form an upper loop 18 and two shock struts 22. The base loop 14 is semi-elliptical in shape, the upper loops 18 is shape like an upward curving semi-ellipse and the shock struts 22, are shaped like arches. The arcuate sections 13 and 15, and 17 and 19, respectively, which form the base loop 14 and the upper loop 18 can be made of any resilient filiform material such as spring wire, composite rod or high strength plastic rod.

The shock strut 22 is of conventional design. The strut 22 is made era series of tubular segments 70 of varying curvature with widened ends 74. In this way the segments 70 can be inserted into one another to form an arch shape. To ensure that the segments 70 are inserted in the correct sequence and to facilitate assembly and disassembly all the segments 70, are retained in sequence on a bungee cord (not illustrated) which is retained internally at either end of the strut 22. To assemble the strut 22 it is only necessary to allow the bungee to pull all the segments 70 into engagement. To disassemble it is only necessary to pull the segments 70 away from one another.

The opposing, semi-elliptical base loop 14 and upper loop 18 are linked to each other via two connectors 26 one in the front 11 of the frame 10 and one in the rear 12. FIG. 1 shows that the opposing, first and second arcuate sections 17 and 19 link to form the base loop 14 which essentially a complete, planar ellipse and the opposing first and second arcuate sections 17 and 19 link to form the upper loop 18 which is a saddle shaped structure. The shock struts 22 are connected to the first and second arcuate sections 13 and 15 by eye hooks 30 and to the first and second arcuate sections 17 and 19 by twist clips 34. These connections will be described in more detail below.

The preferred embodiment of the connector 26 is illustrated in FIGS. 3, 4, 5 and 6. The connector 26 has an elongated body 42 with a through-bore 54. One end of the connector 26 is a fixed end 46 and the other is a insertable end 50. The through-bore 54 goes completely through the body 42 from the fixed end 46 to the insertable end 50. The elongated body 42 has the shape of multiple, parallel, partial, interconnected, fight circular cylinders. In the preferred embodiment, elongated body 42 has the shape of two interconnected cylinders. FIG. 3 illustrates the preferred dimensions for the preferred connector 26. Dimension A is about 3/32 in., dimension B is about 3/16 in., dimension C is about 5/8 in., dimension D is about 5/16 in. and dimension E is about 5 in. In alternate embodiments the elongated body 42 can have the shape of three or more interconnected cylinders. The connector 26 is preferably made as an aluminum extrusion. However, it could be made from other metals, composites or plastics of sufficient strength.

Figure 4:
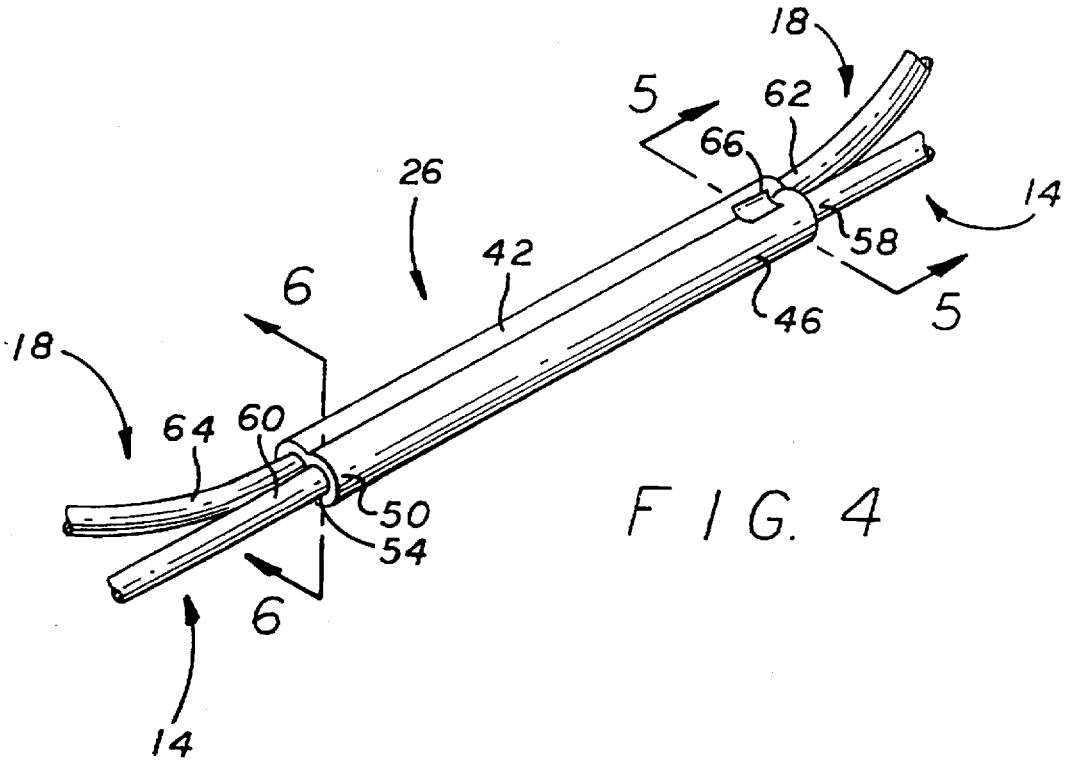
FIG. 4 is an enlarged view of the area shown in circle 4 of FIG. 1, illustrating the assembly of the preferred embodiment of the connector with the terminal ends of the arcuate sections forming the tent frame loops.

FIG. 4 is a magnified detail of the contents of circle 4 of FIG. 1. FIG. 4 illustrates the connector 26 assembled into the preferred tent frame 10. FIG. 4 shows how the terminal ends 58 and, 60 of the first and second arcuate sections 17 and 19, respectively 14 as well as the ends 62, 64 of the upper bops 18 are inserted into the bore 54 at either end 46, 50 of the elongated body 42. FIG. 4 shows ends terminal ends 58 inserted into the fixed end 46 of the elongated body 42. However, since the arcuate sections that from the base loop 14 and the upper loop 18, respectively, are symmetrical, the exact orientation is immaterial. The dimension of the bore 54 is such that the terminal ends 58, 60, 62, 64 will be retained internally in the preferred embodiment largely by friction between the arcuate sections 13 and 15 of base loop 14 and arcuate sections 17 and 19 of upper loop 18; and the elongated body 42. The depth of penetration of the terminal ends 58, 60, 62, 64 into the bore 54 can be varied but in the preferred embodiment will extend midway as shown in FIG. 6. The terminal ends 58, 62 are retained inside the bore 54 of the fixed end 46 by swaging. This results in a swaging depression 66 close to the fixed end 46. While swaging is the preferred method of attachment, other means of attachment, such as welding or adhesive bonding could also be used, especially if the connector 26 is not made out of an aluminum extrusion.

FIG. 5 is a transverse cross section of the assembled connector 26 at the location illustrated in FIG. 4. FIG. 5 clearly shows swaging depression 66 of the elongated body 42 as a result of the swaging operation, which secures the terminal ends 58,62 inside the bore 54.

FIG. 6 is a axial cross section of the assembled connector 26 at the location illustrated in FIG. 4. FIG. 6 again shows the swaging depression 66 of the elongated body 42 which traps the terminal 58 inside the bore 54 at the fixed end 46 of the connector 26. FIG. 6 also shows, schematically, the loose fit of the terminal end 60 inside the bore 54 at the insertable end 50 of the connector 26. As a result, the terminal end 60 can be inserted into and removed from the bore 54, be rotated inside the bore 54, and swiveled from side to side. All these motions are shown by arrows on FIG. 6. In the preferred embodiment, the terminal ends 60 and 64 are retained inside the bore 54 at the insatiable end 50 of the connector 26 mainly by friction. The mount of frictional force required to move terminal ends 60 and 64 is dictated by the diameter of the terminal ends 60 and 64 of arcuate sections 15 and 19 in relation to dimensions of the bore 54 and the tension in the arcuate sections 15 and 19.

Figure 7:
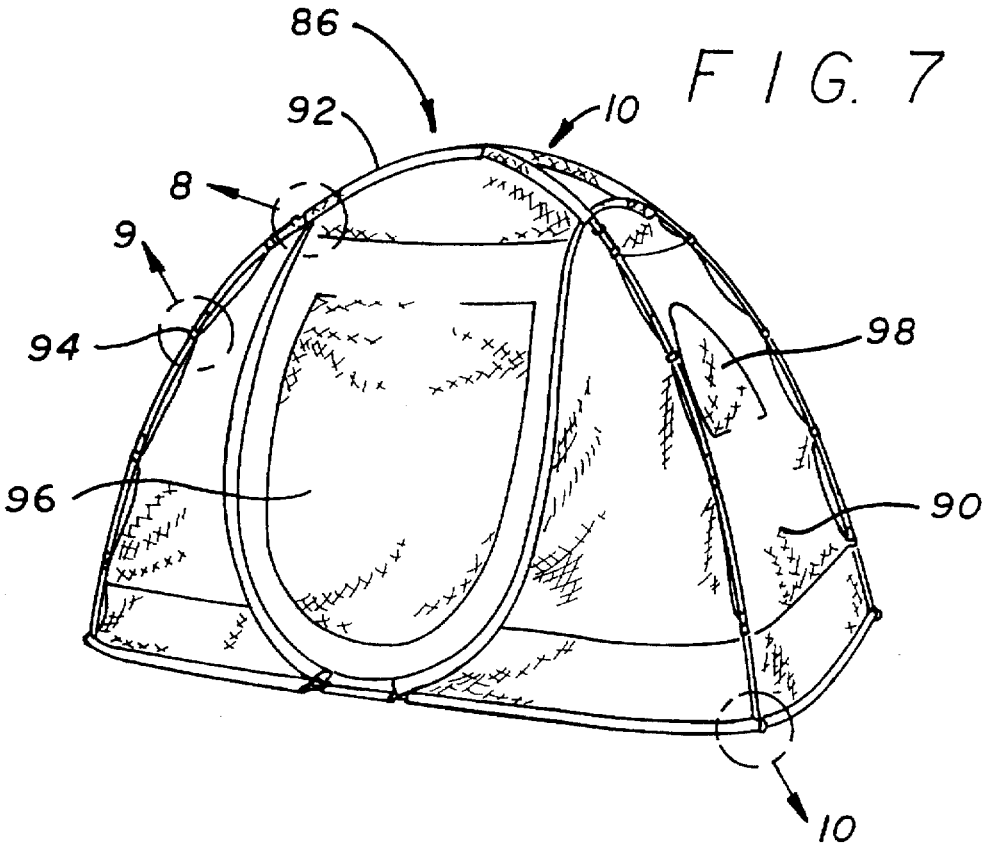
FIG. 7 is a perspective view of a tent according to this invention in its fully erected position.

FIG. 7 shows the fully erected tent 86 in accordance with this invention, with the fabric covering 90 draped over and attached to the frame 10. In conventional manner, attachment is made by means of sleeves 92, sewn into the fabric 90 and clips attached by sewing to the fabric 90. In conventional manner, the fabric covering 90 is provided with a door 96 and one or more windows 98.

Figure 8:
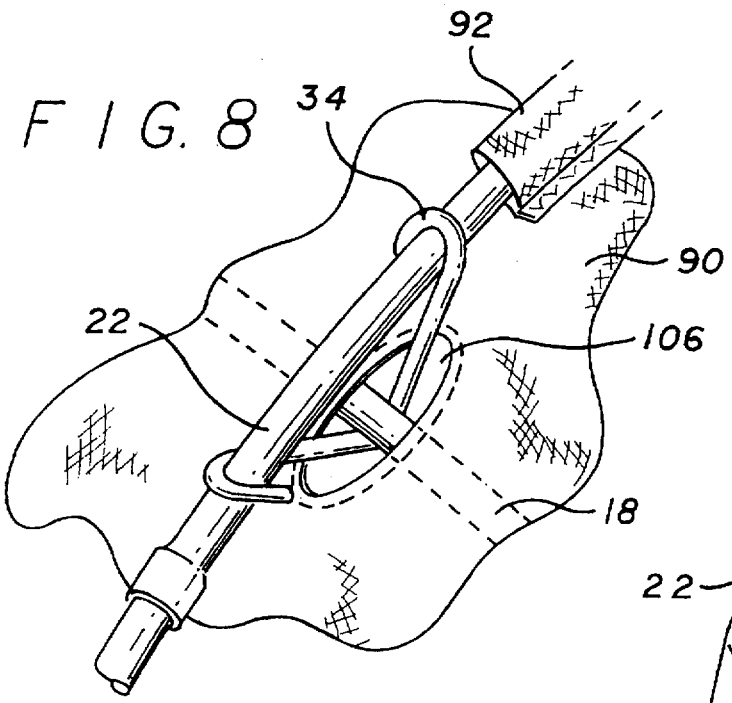
FIG. 8 is an enlarged view of the area shown in circle 8 of FIG. 7, illustrating connection of the shock strut to an arcuate section of the upper loop via a twist clip.

FIG. 8 illustrates connection of the shock strut 22 to the upper loop 18 by means of a conventional twist clip 34, which protrudes through a hole 106 in the fabric 90. One of the sleeves 92 is better illustrated in this Figure. Alternate methods of attachment are commercially available.

Figure 9:
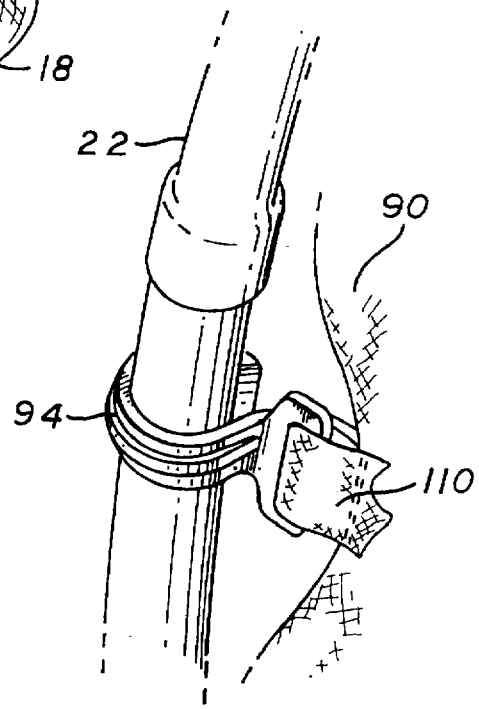
FIG. 9 is an enlarged view of the area shown in circle 9 of FIG. 7, illustrating connection of the fabric to the shock strut via a sewn-in C-clip.

FIG. 9 illustrates attachment of the fabric 90 to the shock strut 22 by means of a C-clip 94. In the conventional method shown in this Figure, the clip 94 is attached to a tab 110 which is sewn on the fabric 90. Other conventional methods to make this attachment are available on the marketplace.

Figure 10:
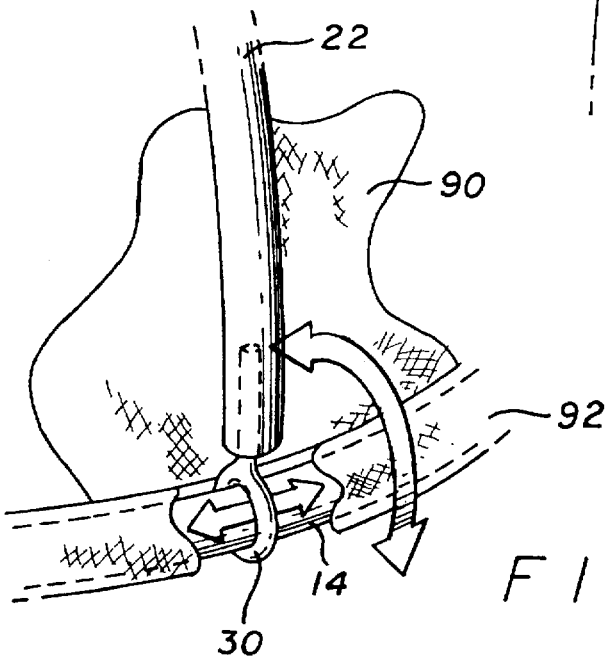
FIG. 10 is an enlarged view of the area shown in circle 10 of FIG. 7, illustrating how the shock strut is attached to the base loop with an eye hook and how the base loop runs through pockets sewn into the tent fabric.

FIG. 10 illustrates attachment of the shock strut 22 to the base loop 14. An eye hook 30 is fastened into the end of the shock strut 22. This eye hook 30 encircles the loop 14 forming a permanent slidable and rotatable attachment. Sliding and rotational motions are shown by arrows on the Figure. This Figure again provides a better illustration of a typical sleeve 92.

The tent 86, described above, and more particularly the frame 10, is designed so that, by coiling the frame 10, the tent 86 can be quickly and easily made into a disk for convenient transportation and storage. Storing the tent 86 is accomplished by manually pulling apart the segments 70 of the shock struts 22, coiling the frame 10 and securing the tent 86 in this position. When it is desired to use the tent 86, the frame 10 is allowed to assume its unconstrained shape and the segments 70 of the shock struts 22 are manually reassembled. It takes approximately two minutes to erect or flatten the tent 86. While all loops 14, 16, 18, 20 have been described as having particular shapes, other shapes can be used.

Figure 2:
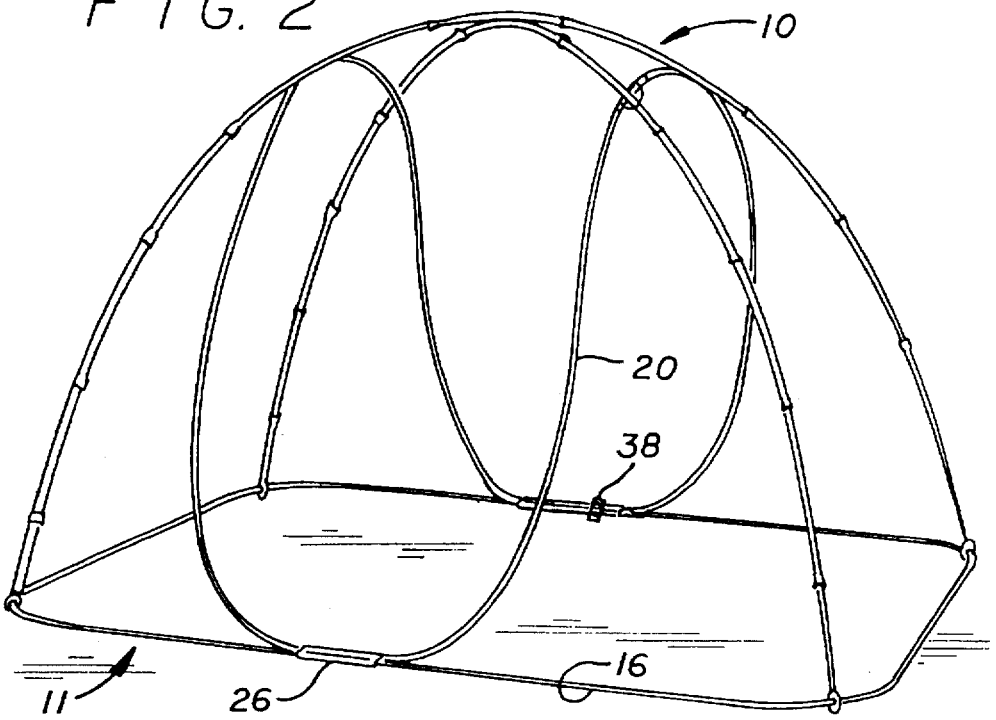
FIG. 2 shows a perspective view of an alternate embodiment of the erected tent frame.

FIG. 2 illustrates an alternate embodiment of the frame 10 for use with the fast erecting tent 86. In This embodiment there is only one base loop 16, upper loop 20 and connector 26. The base loop 16 is comprised of a single arcuate section that is approximately a complete planar ellipse. The upper loop 20 forms an almost complete saddle shape. The base loop 16 and upper loop 20 loops are linked via the signal connector 26 which is located in the front 11 of the frame 10. In the rear 12 of the frame 10, the base loop 16 and upper loop 20 are fastened to each other by means of a standard clip 38.

While FIGS. 1 and 2 illustrate embodiments of this invention having either first and second open-ended arcuate sections 17 and 19 that form the upper loop 18 or a single arcuate section that forms the single upper loop 20, the present invention could have additional arcuate sections to form additional partial upper loops or that approximate the form of a complete loop.

The improved tent 86, frame 10 and connector 26 have been described with reference to a particular embodiment. Other modifications and enhancements can be made without departing from the spirit and scope of the claims that follow.

What is claimed is:

1. A fast erecting tent comprising:

a first plurality of open-ended arcuate sections for forming a base loop, each of said first plurality of arcuate sections having a first terminal end and a second terminal end;

a second plurality of open-ended arcuate sections for forming an upper loop, each of said second plurality of arcuate sections having a third terminal end and a fourth terminal end;

a plurality of connectors with each connector attached to said first plurality of arcuate sections and said second plurality of arcuate sections for forming an inner frame, each connector being formed of a plurality of parallel interconnected cylinders each having a first end tip and a second end tip, a through-bore, and a solid, continuously-closed outer surface along a longitudinal axis, said first end tips of said cylinders of each connector fixedly securing said first terminal end and said third terminal end, and said second end tips of said cylinders of each connector securing by friction said second terminal end and said fourth terminal end, said second and said fourth terminal ends being rotatable, slidable and pivotable within and insertably removable from said second end tips;

a plurality of segmented, arcuate, flexible tubular struts extending over and attached to said first plurality and said second plurality of arcuate sections for forming an external frame; and a fabric membrane wrapped about said first plurality and said second plurality of arcuate sections and said plurality of struts for forming a tent enclosure.

2. The fast erecting tent of claim 1 wherein said first plurality of open-ended arcuate sections forming said base loop comprises two open-ended arcuate sections.

3. The fast erecting tent of claim 1 wherein said second plurality of open-ended arcuate sections forming said upper loop comprises two open-ended arcuate sections.

4. The fast erecting tent of claim 1 wherein said first plurality of open-end arcuate sections and said second plurality of open-ended arcuate sections are comprised of spring steel.

5. The fast erecting tent of claim 1 wherein said first plurality of open-end arcuate sections and said second plurality of open-end arcuate sections are comprised of composite rod.

6. The fast erecting tent of claim 1 wherein said first plurality of open-end arcuate sections and said second plurality of open-ended arcuate sections are comprised of high strength plastic rod.

7. The fast erecting tent of claim 1 wherein each of said connectors is formed of two parallel interconnected cylinders.

8. The fast erecting tent of claim 1 wherein said first terminal end and said third terminal end are fixedly secured to said first end tips of said cylinders by swaging.

9. The fast erecting tent of claim 1 wherein each of said plurality of tubular struts is attached to said first plurality of arcuate sections with a plurality of eye hooks.

10. The fast erecting tent of claim 1 wherein each of said plurality of tubular struts is attached to said second plurality of arcuate sections with a plurality of twist dips.

11. The fast erecting tent of claim 1 wherein said fabric membrane is attached to said plurality of tubular struts with a plurality of C-clips.

12. The fast erecting tent of claim 1 wherein said fabric membrane includes a pert for entry and egress.

13. The fast erecting tent of claim 1 wherein said fabric membrane includes at least one window.

14. A fast erecting tent comprising:

a first open-ended arcuate section for forming a base loop, said first arcuate section having a first terminal end and a second terminal end;

a second open-ended arcuate section for forming an upper loop, said second arcuate section having a third terminal end and a fourth terminal end;

a clip for attaching said first arcuate section to said second arcuate section;

a connector attached to said first arcuate section and said second arcuate section for forming an inner frame, said connector being formed of a plurality of parallel interconnected cylinders each having a first end tip and a second end tip, a through-bore, and a solid, continuously-closed outer surface along a longitudinal axis, said first end tips of said cylinders fixedly securing said first terminal end and said third terminal end, and said second end tips of said cylinders securing by friction said second terminal end and said fourth terminal end, said second and said fourth terminal ends being rotatable, slidable and pivotable within and insertably removable from said second end tips;

a plurality of segmented, arcuate, flexible tubular struts extending over and attached to said first and said second arcuate sections for forming an external frame; and a fabric membrane wrapped about said first and said second arcuate sections and said plurality of struts for forming a tent enclosure.

15. A connector for use with a tent having a plurality of open-ended arcuate sections comprising:

an elongated body formed of a plurality of parallel interconnected cylinders with each cylinder having a first end and a second end, a through-bore, and a solid, continuously closed outer surface along a longitudinal axis;

said first end of each of said cylinders fixedly securing one of a first plurality of terminal ends of a first set of said open-ended arcuate sections; and said second end of each of said cylinders securing by friction one of a second plurality of terminal ends of a second set of said open-ended arcuate sections positioned in opposition to said first plurality of terminal ends, wherein said second plurality of terminal ends are rotatable, slidable and pivotable within and insertably removable from said through-bore at said second end of each of said cylinders.

* * * * *